US007712196B2

(12) United States Patent
Kawamura et al.

(10) Patent No.: US 7,712,196 B2
(45) Date of Patent: May 11, 2010

(54) BELT LOCK

(75) Inventors: Ryoji Kawamura, Taipei (TW); Ming Hui Chen, Taoyuan (TW)

(73) Assignee: YKK Corporation, Tokyo (JP)

( * ) Notice: Subject to any disclaimer, the term of this patent is extended or adjusted under 35 U.S.C. 154(b) by 835 days.

(21) Appl. No.: 11/496,273

(22) Filed: Jul. 31, 2006

(65) Prior Publication Data

US 2007/0044285 A1 Mar. 1, 2007

(30) Foreign Application Priority Data

Aug. 2, 2005 (JP) ..... 2005-224514

(51) Int. Cl.
*A44B 11/25* (2006.01)
*A44B 11/26* (2006.01)

(52) U.S. Cl. ..... 24/630; 24/579.11; 24/631

(58) Field of Classification Search ..... 24/614, 24/615, 625, 662, 265 BC, 265 R, 616, 579.11, 24/630, 631
See application file for complete search history.

(56) References Cited

U.S. PATENT DOCUMENTS

| | | | | |
|---|---|---|---|---|
| 796,414 | A * | 8/1905 | Chayes | 24/627 |
| 3,925,853 | A | 12/1975 | Nicklin | |
| 4,099,306 | A | 7/1978 | Matthews et al. | |
| 4,704,771 | A | 11/1987 | Orje | |
| 5,125,718 | A | 6/1992 | Czernakowski et al. | |
| 5,148,582 | A * | 9/1992 | Dennis, Jr. | 24/625 |
| 5,671,516 | A * | 9/1997 | Sartori | 24/616 |
| 6,049,954 | A | 4/2000 | Britto | |
| 6,076,237 | A * | 6/2000 | Goorhouse | 24/200 |
| 6,226,844 | B1 * | 5/2001 | Lerra et al. | 24/625 |
| 6,283,350 | B1 | 9/2001 | Gottmeier et al. | |
| 6,309,024 | B1 | 10/2001 | Busch | |
| 6,363,590 | B1 * | 4/2002 | Lan | 24/614 |
| 6,543,101 | B2 | 4/2003 | Sack et al. | |
| 6,571,434 | B2 * | 6/2003 | Ortiz | 24/615 |
| 6,705,641 | B2 | 3/2004 | Schneider et al. | |
| 6,711,785 | B1 * | 3/2004 | Hicks et al. | 24/3.4 |
| 6,735,828 | B2 * | 5/2004 | Kaneko | 24/615 |
| 6,837,547 | B2 | 1/2005 | Delventhal et al. | |

(Continued)

FOREIGN PATENT DOCUMENTS

EP 0046672 A 3/1982

(Continued)

OTHER PUBLICATIONS

Search Report for Taiwanese Patent Application No. 095128182.

(Continued)

*Primary Examiner*—Robert J Sandy
(74) *Attorney, Agent, or Firm*—Alston & Bird, LLP

(57) ABSTRACT

A belt lock includes a plug (20) and an attachment (30) to be detachably attached to the plug (20). The attachment (30) includes a belt attaching hole (32). The plug (20) is provided with a rail (26). The attachment (30) is provided with a groove (31) to be slidably engaged with the rail (26). The rail (26) is provided with a lock section (a recess) (27). The groove (31) is provided with a to-be-locked section (a protrusion) (34) to be engaged with the lock section (the recess) (27).

3 Claims, 9 Drawing Sheets

U.S. PATENT DOCUMENTS

| | | | | |
|---|---|---|---|---|
| 2002/0017012 | A1 | 2/2002 | Sack et al. | |
| 2005/0125970 | A1* | 6/2005 | Nolan | 24/615 |
| 2006/0070215 | A1* | 4/2006 | Sung | 24/615 |
| 2006/0288546 | A1* | 12/2006 | Wu | 24/615 |

FOREIGN PATENT DOCUMENTS

| | | | |
|---|---|---|---|
| EP | 0225719 | | 9/1989 |
| GB | 2286851 | | 8/1995 |
| JP | 55-090309 | U | 7/1980 |
| JP | 61-176302 | A | 8/1986 |
| JP | 62-148601 | A | 11/1987 |
| JP | 06-284915 | A | 10/1994 |
| JP | 9-308508 | | 12/1997 |
| JP | 11-266908 | | 10/1999 |
| WO | WO 90/09747 | | 9/1990 |

OTHER PUBLICATIONS

Office Action for Japanese Patent Application No. 2005-224514.

* cited by examiner

BELT LOCK

BACKGROUND OF THE INVENTION

1. Field of the Invention

The present invention relates to a belt lock for locking a belt. Specifically, the invention relates to a belt lock including a base and an attachment to be detachably attached to the base, the attachment having a belt attaching section for attaching a belt.

2. Description of Related Art

As a belt lock for locking a belt, there has been known a buckle that can connect a plurality of belts to each other and separate the plurality of belts from each other. For example, as a buckle that can connect five seatbelts (a crotch belt, right and left waist belts, right and left shoulder belts) to each other and separate the five seatbelts from each other, a five-direction buckle has been known (see, for example, Document 1: JP-A-9-308508 and Document 2: U.S. Pat. No. 6,543,101).

The buckle includes: a socket; a pair of plugs to be disengageably inserted in the socket from openings on right and left sides of the socket; and attachments to be slidably attached to upper edges of the plugs. The socket includes a crotch belt attaching section for attaching the crotch belt. The plugs on the right and left sides each include a waist belt attaching hole for attaching the right or left waist belt. The attachments each include a shoulder belt attaching hole for respectively attaching the right and left shoulder belts. The plugs each include a rail with which a groove of the respective attachments is engaged. The rail has a stopper on an outer end of the rail.

In use, the attachments are firstly slid along the respective rails of the plugs to be attached to the plugs, and the plugs are inserted in the socket from the openings on the right and left sides of the socket to be engaged with the socket. Each of the attachments attached to the plugs is sandwiched by the stopper of the plug and a stopper of the socket, so that the attachments are prevented from dropping from the respective plugs.

Hence, even when tensile force is applied on the seatbelts (the crotch belt, the right and left waist belts, and the right and left shoulder belts), the plugs do not become disengaged from the socket and the attachments do not become disengaged from the plugs, so that the seatbelts are securely connected.

With the buckle having the above-described structure, when the plugs are inserted in and engaged with the socket, the attachments do not become disengaged owing to the stoppers of the plugs and the socket. However, when the plugs are disengaged from the socket, the attachments may become disengaged from the respective plugs. Specifically, when the plug is disengaged from the socket, the attachment may become disengaged from the plug contrary to the intention of an operator since the stopper of the socket does not act on the attachment.

In a general use, disengaging the plugs from the socket enables the shoulder belts to slip off the shoulders of an infant, so that it is not necessary to disengage the attachments from the plugs.

However, if the attachment is disengaged from the plug when the plug is disengaged from the socket, an operation for engaging the plug and the socket becomes complicated, which is not preferable. Concretely, because it becomes necessary to do an additional operation of attaching the attachment to the plug before inserting the plug into the socket for re-engagement, the operation for engaging the plug and the socket becomes complicated.

SUMMARY OF THE INVENTION

An object of the present invention is to provide a belt lock in which an attachable/detachable attachment does not become disengaged contrary to the intention of an operator.

A belt lock of an aspect of the invention includes: a base; and an attachment to be detachably attached to the base, the attachment having a belt attaching section for attaching a belt. One of the base and the attachment is provided with a rail. The other of the base and the attachment is provided with a groove to be slidably engaged with the rail. The rail is provided with a lock section. The groove is provided with a to-be-locked section to be engaged with the lock section.

According to the aspect of the invention, since the attachment is attachable to and detachable from the base, the belt attached to the belt attaching section of the attachment can also be connected to and separated form the base. When the attachment is attached to the base, the rail and the groove slide on each other to be engaged with each other and the lock section of the rail and the to-be-locked section of the groove are locked to each other, so that the attachment can be prevented from being disengaged from the base contrary to the intention of an operator, thereby providing good operability of the attachment and the base.

With the belt lock of the aspect of the invention, one of the lock section and the to-be-locked section may preferably be formed as a recess and the other of the lock section and the to-be-locked section may preferably be formed as a protrusion to be engaged with the recess. One of the recess and the protrusion may preferably have a V-shape slope along the sliding direction of the rail and the groove.

According to the aspect of the invention, since one of the lock section and the to-be-locked section is formed as the recess and the other is formed as the protrusion, the lock section and the to-be-locked section can be securely locked to each other with the simple arrangement. In addition, the inclinations like V are provided in one of or both of the recess and the protrusion along the sliding direction. Hence, when the groove is slid on and engaged with the rail for engagement, one of the inclinations of the V-shape facilitates the engagement. On the other hand, when the engagement between the rail and the groove is released, the other of the inclinations of the V-shape facilitates the disengagement.

With the belt lock of the aspect of the invention, the rail may preferably include: a root section continuously formed from one of the base and the attachment; and a tip end section formed on a tip end side of the root section. The tip end section may preferably have a width larger than that of the root section. A width of the groove on a depth side may preferably be larger than that on an open side. The lock section may preferably be formed as a recess on an outer surface on a tip end side of the rail. The to-be-locked section may preferably be formed as a protrusion to be engaged with the recess.

According to the aspect of the invention, since the rail is formed in the shape in which the width of the root section is larger than that of the tip end section and the groove is formed in the shape in which the width thereof on the open side is larger than that on the depth side, thereby providing a structure in which the rail and the groove will not be easily disengaged from each other except for in the sliding direction. Further, the recess (the lock section) is formed on the outer surface of the tip end section of the rail and the protrusion to be locked in the recess (the to-be-locked section) is formed in the groove, thereby enabling the rail and the groove to engage with each other without looseness therebetween.

With the belt lock according to the aspect of the invention, the to-be-locked section may preferably be provided on a connecting section connecting front and rear walls in a direction in which the attachment is slid. The to-be-locked section may preferably be disposed at a middle position between the front and rear walls in the sliding direction of the attachment. The connecting section may preferably be deformable in a direction in which the lock section and the to-be-locked section are engaged.

According to the aspect of the invention, since the to-be-locked section is disposed in the middle of the connecting section that connects the forward and backward side walls in the sliding direction of the attachment, the connecting section can be easily deformed. Hence, the lock section and the to-be-locked section can be locked with a relatively small force. Owing to the structure in which the connecting section is deformed in the direction in which the lock section and the to-be-locked section are locked to each other, it is not necessary to employ a mechanism for displacing the lock section and the to-be-locked section, thereby simplifying the structure.

With the belt lock of the aspect of the invention, a socket and a plug that is disengageable from the socket are provided as the base. The plug includes: a base section; and an engaging section that projects from the base section and is inserted in and engaged with the socket. The base section includes the rail. The rail is formed substantially in parallel to a direction in which the plug is inserted into the socket. The attachment includes the groove to be slidably engaged with the rail.

According to the aspect of the invention, the invention can be applied as a buckle having the socket and the plug, and the buckle can provide the above-described advantages.

DETAILED DESCRIPTION OF PREFERRED EMBODIMENT(S)

An embodiment of the present invention will be described below with reference to the attached drawings.

Figure 1:
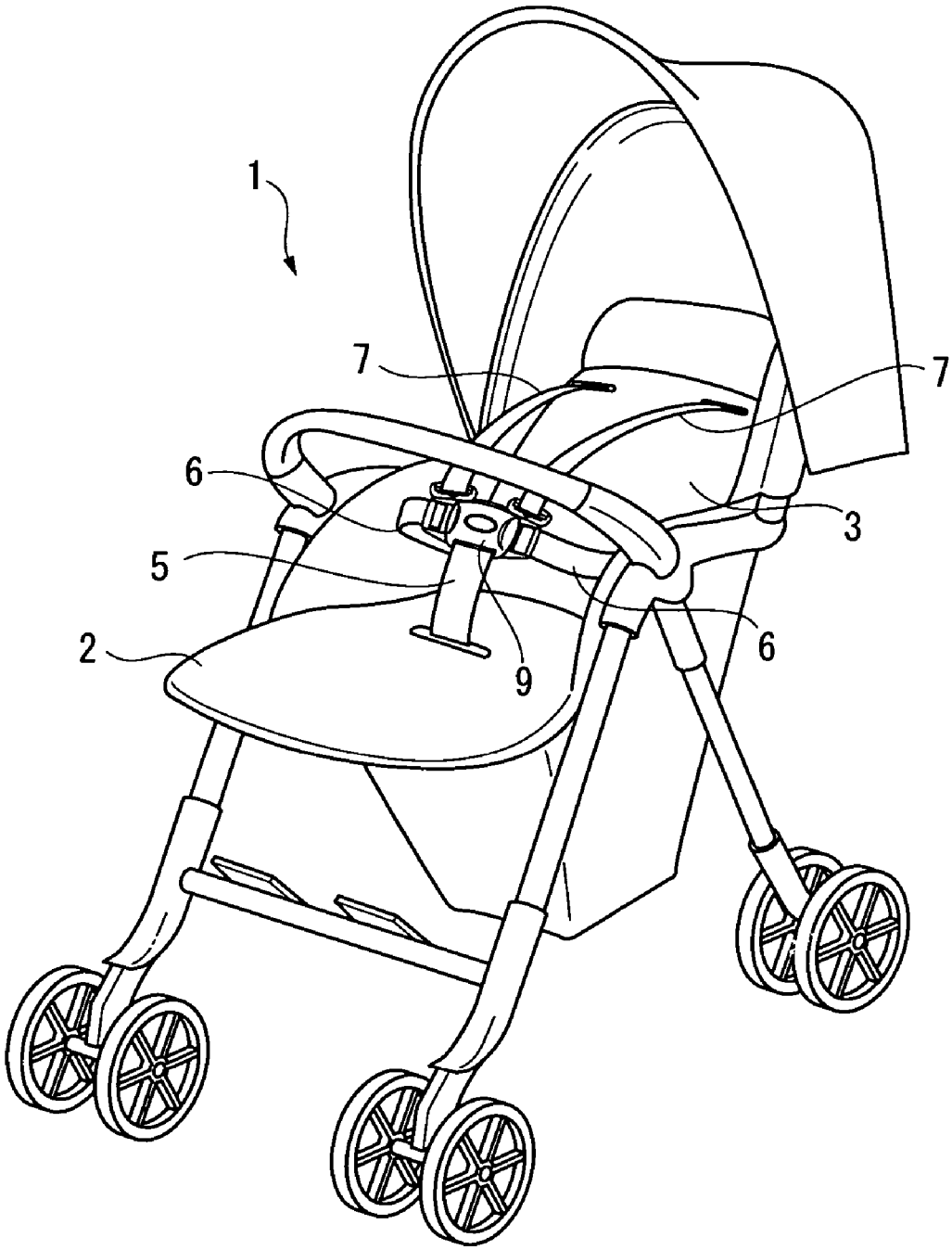
FIG. 1 is a whole perspective view showing an embodiment of the invention.
Figure 2:
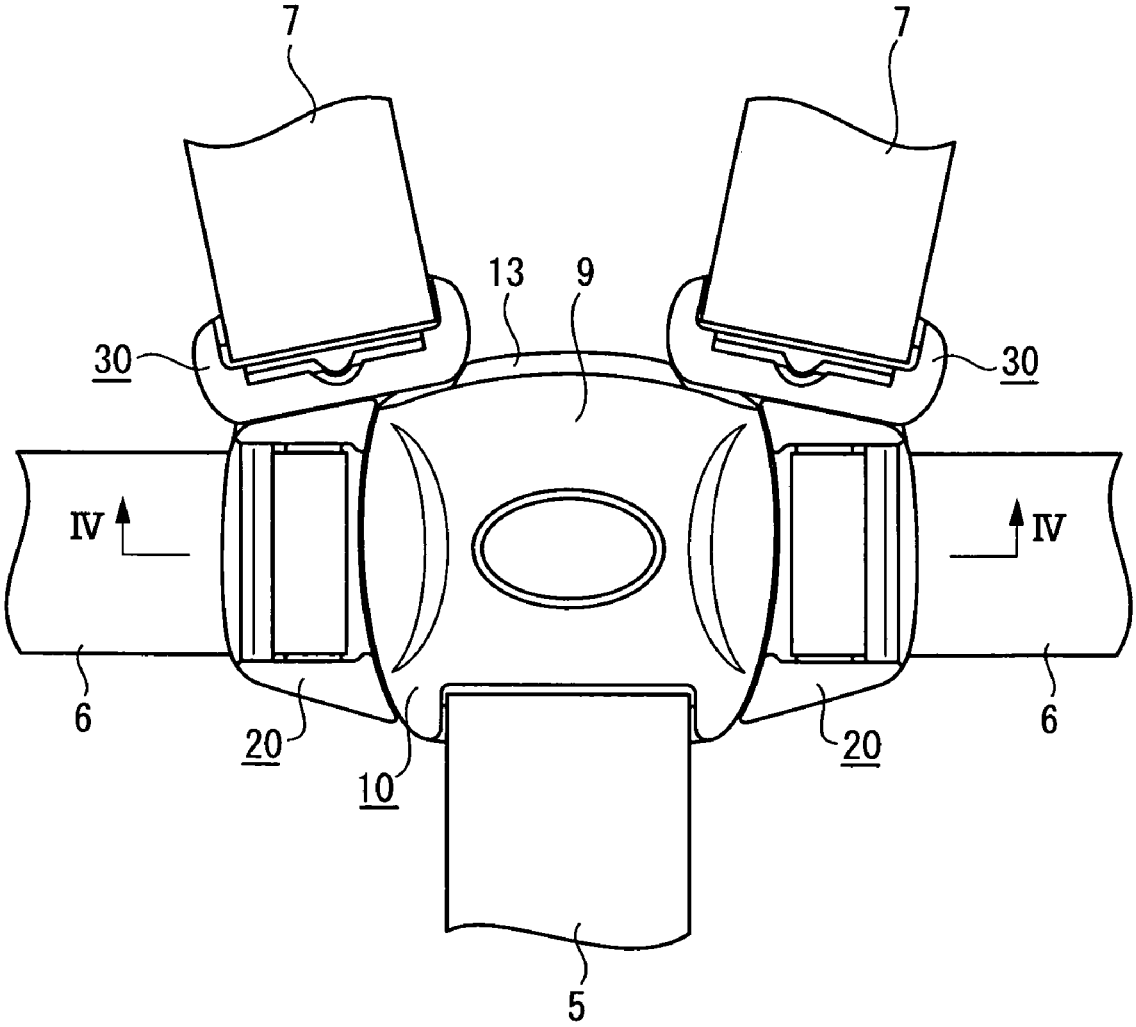
FIG. 2 is a front view of a belt lock when seen from a front side of the belt lock according to the aforesaid embodiment.
Figure 3:
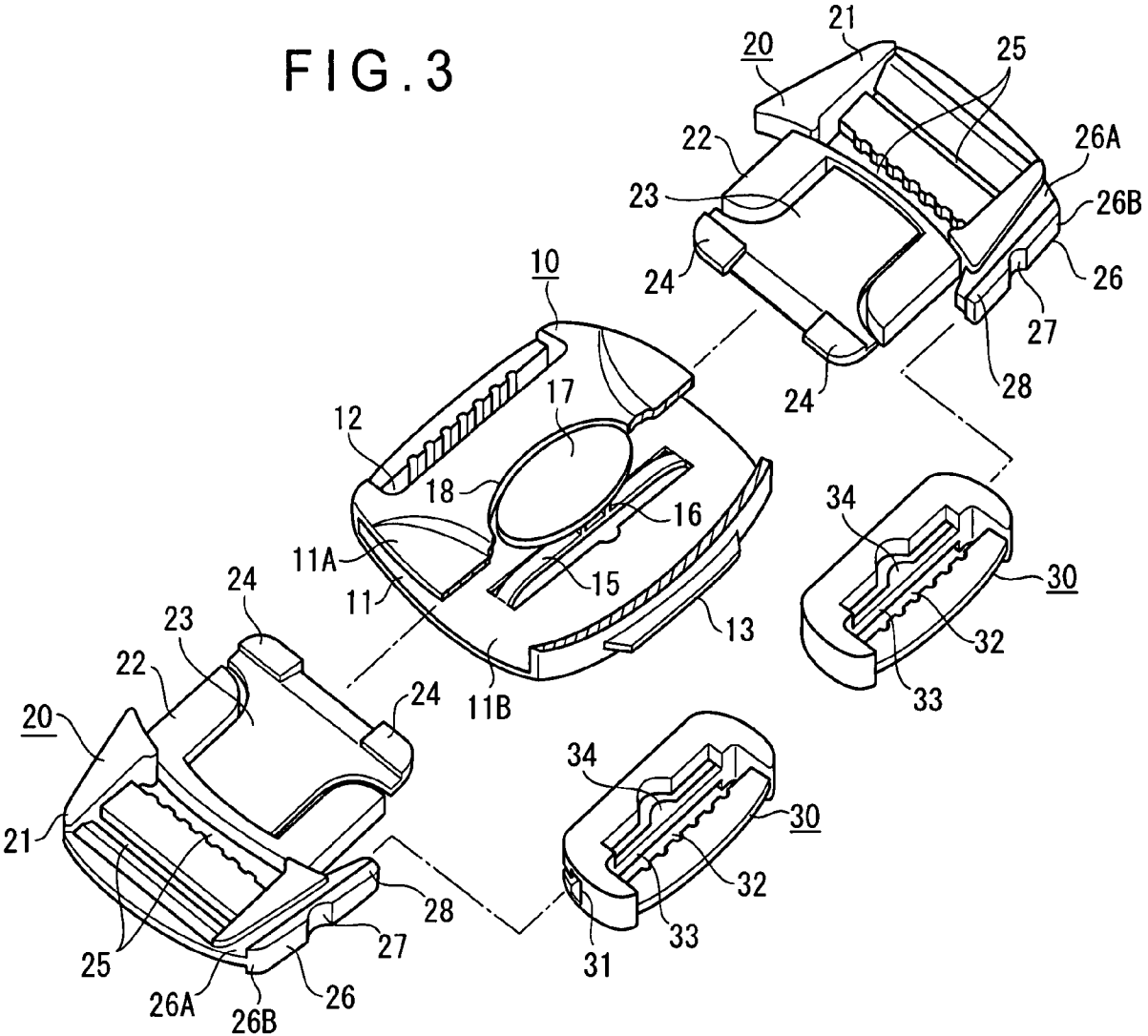
FIG. 3 is an exploded perspective view of the belt lock according to the aforesaid embodiment.
Figure 4:
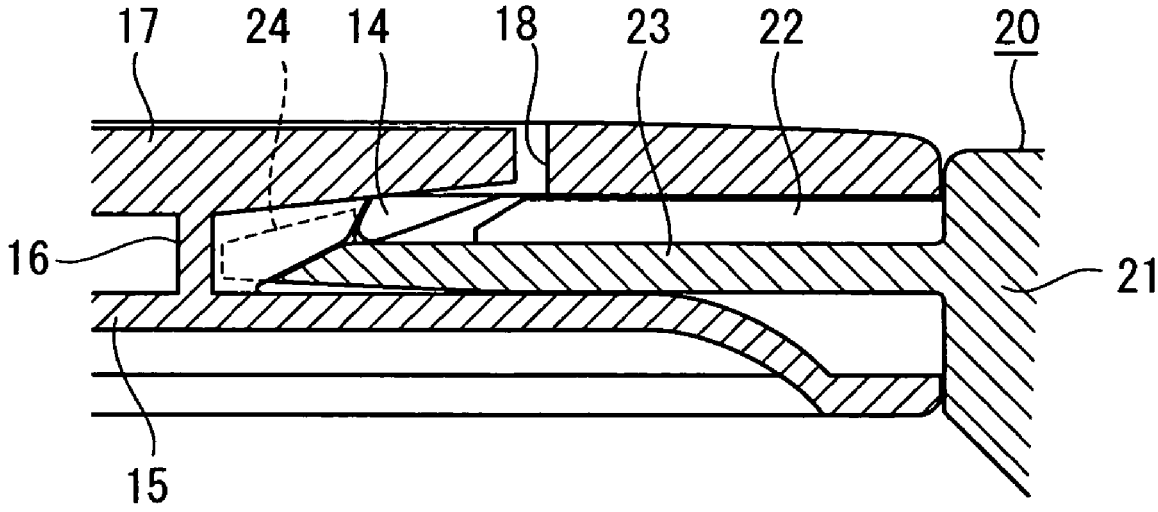
FIG. 4 is a (partial) cross section taken along line IV-IV of FIG. 2.
Figure 5A:
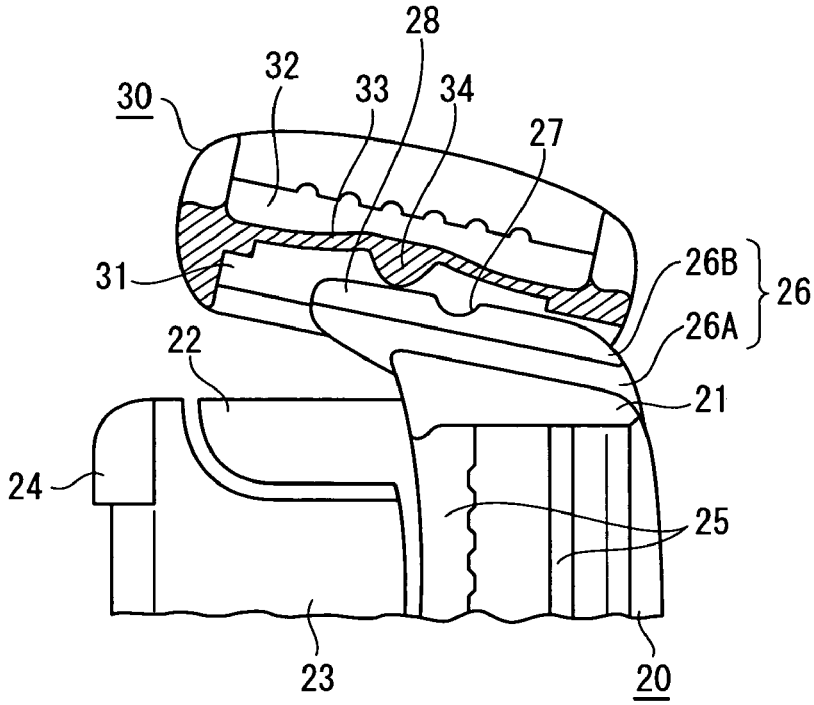
FIGS. 5A and 5B are cross sections showing a plug and an attachment in engagement according to the aforesaid embodiment.
Figure 5B:
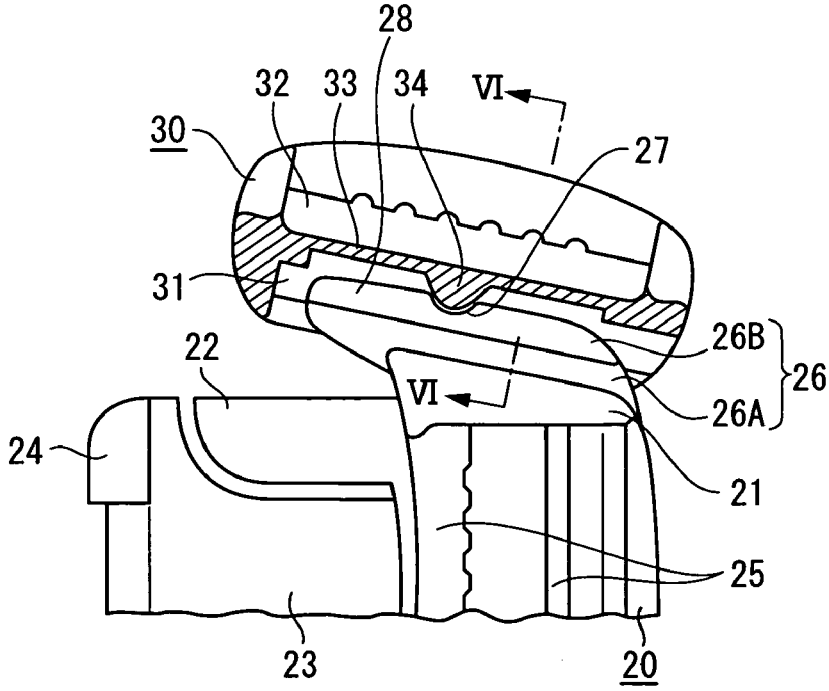
Figure 6:
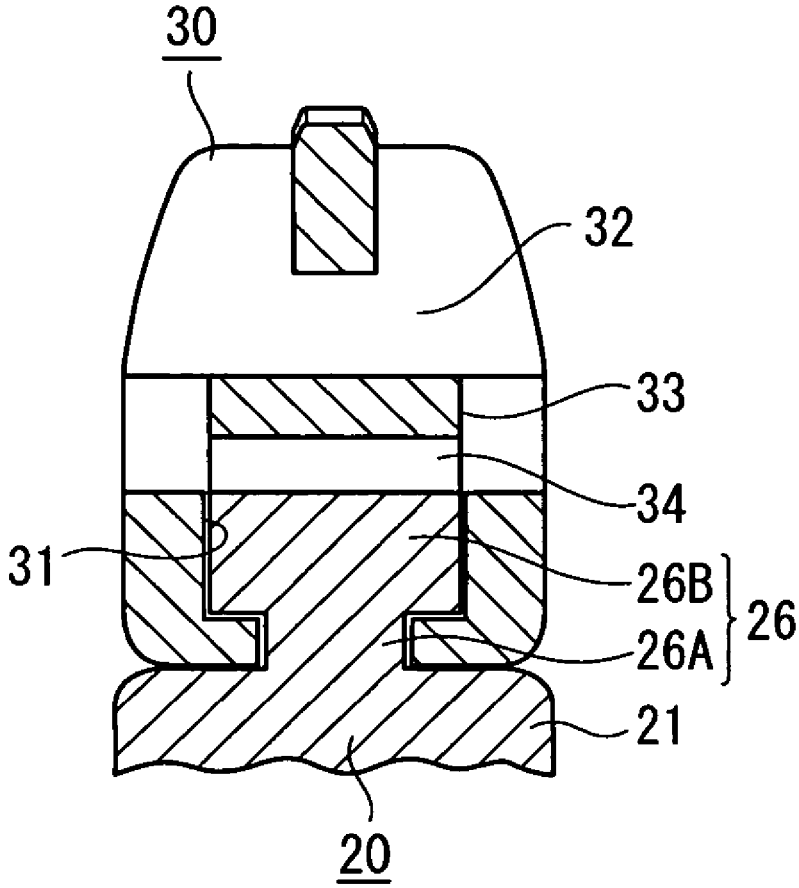
FIG. 6 is a cross section taken along line VI-VI of FIG. 5B.
Figure 7:
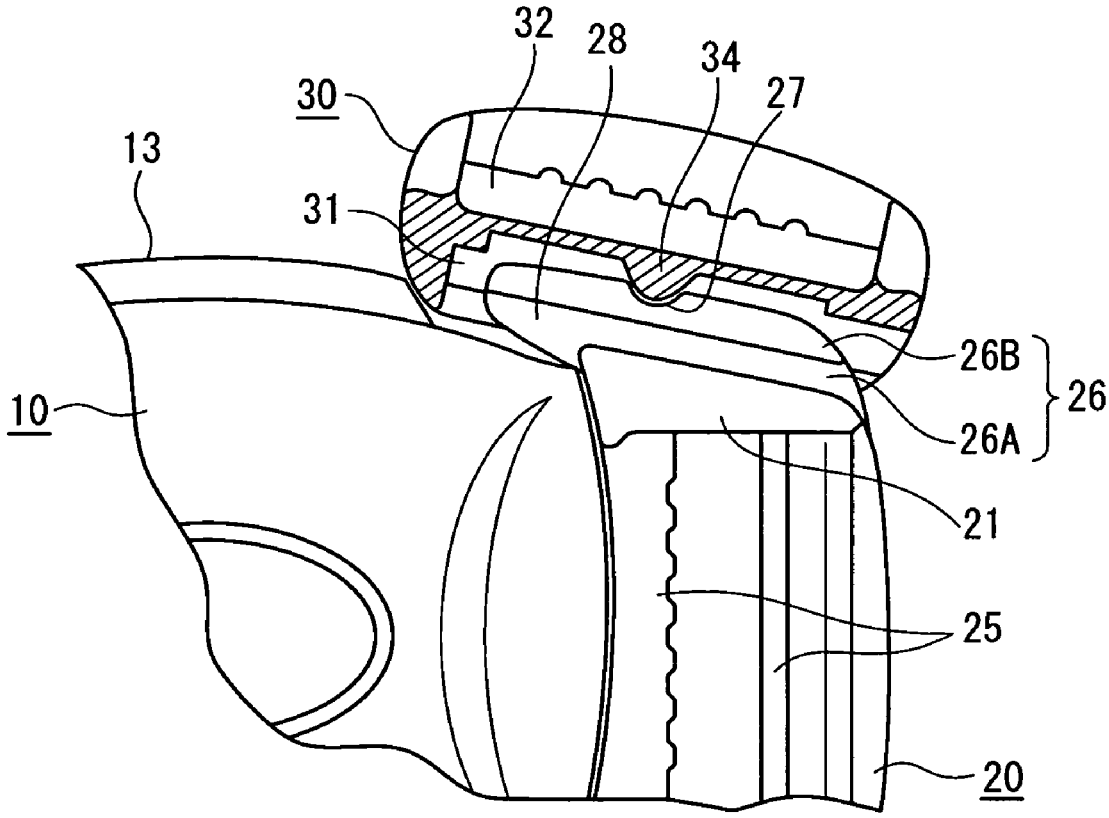
FIG. 7 is a view showing the plug and the socket in engagement according to the aforesaid embodiment.

FIGS. 1 to 7 illustrate the embodiment of the invention. FIG. 1 is a whole perspective view showing a belt lock of the invention which is applied to seatbelts of a baby buggy. FIG. 2 is a front view of the belt lock. FIG. 3 is an exploded perspective view of the belt lock. FIG. 4 is a cross section of a socket and a plug in engagement. FIGS. 5A and 5B are cross sections of the plug and an attachment in engagement. FIG. 6 is a cross section taken along line VI-VI in FIG. 5B. FIG. 7 is a partially enlarged view showing the plug and the socket in engagement.

As shown in FIG. 1, the seatbelts of the baby buggy includes a crotch belt 5, a pair of waist belts 6 and a pair of shoulder belts 7. The crotch belt 5 extends upward with a first end fixed to a seat 2 and a second end oriented upward. The pair of waist belts 6 extends forward with first ends fixed to a backrest 3 on left and right sides of the backrest 3 and with second ends oriented forward. The pair of shoulder belts 7 extends downward with first ends fixed to the bracket 3 on an upper side of the backrest 3 and second ends oriented downward. A belt lock 9 of the embodiment is provided at a position where the second ends of the belts 5, 6 and 7 intersect. Note that an upward direction of the belt lock 9 is defined as a direction toward the shoulder belts 7 side, while a downward direction of the belt lock 9 is defined as a direction toward the crotch belt 5 side in the following description.

As shown in FIGS. 2 and 3, the belt lock 9 of the embodiment includes: a socket 10 connected to the second end of the crotch belt 5; a pair of plugs (bases) 20 respectively connected to the second ends of the waist belts 6, the plugs 20 detachably inserted in the socket 10 from openings on right and left sides of the socket 10; and attachments 30 respectively connected to the second ends of the shoulder belts 7, the attachments slidably attached on upper edges of the plugs 20. Note that these components (the socket 10, the pair of plugs 20 and the pair of attachments 30) are made of resin and formed by injection molding.

The socket 10 has a flat cylindrical shape with an insertion hole 11 defining openings in right and left surfaces of the socket 10. The socket 10 includes: a belt attachment hole 12 (a crotch belt attaching section) for attaching the crotch belt 5, the belt attachment hole 12 provided in a lower edge of the socket 10 (the upper side in FIG. 3); and a stopper 13 that extends in a brim-like manner, the stopper 13 provided in the middle of an upper edge of the socket 10. In the insertion hole 11, four to-be-engaged sections 14 are formed on an inner surface of a front wall 11A (see FIG. 4) so as to extend inward. In the middle portion of a rear wall 11B, an elastic leg piece 15 is cut and folded so as to project inward from the rear wall 11B, the elastic leg piece 15 being in parallel to a direction of the insertion hole 11. An operating section 17 is integrally formed via a connecting section 16 on the elastic leg piece 15. The operating section 17 has an elliptical shape and is exposed from an opening 18 formed in the middle of the front wall 11A.

The plug 20 is provided with a base section 21 in a flat trapezoidal shape, a supporting section 22 substantially in a U-shape in plan view and a tongue piece 23. The supporting section 22 and the tongue piece 23 are integrally formed to the base section 21 so as to extend from a first end of the base section 21. The supporting section 22 and the tongue piece 23 are inserted in the insertion hole 11 of the socket 10. Engaging sections 24 are integrally formed on upper and lower ends of a tip of the tongue piece 23. The engaging sections 24 are engaged with the to-be-engaged sections 14 provided on the front wall 11A inside the insertion hole 11. The base section 21 is provided with a belt attaching hole 25 (a waist belt attaching section) for attaching the right or left waist belt 6. A rail 26 is integrally formed on an upper edge of the base section 21.

In this embodiment, the rail 26 is formed on the upper side of the base section 21 to which the right or the left waist belt 6 is attached. However, the rail 26 may be formed on the lower side of the base section 21. The rail 26 is formed substantially in parallel to a direction in which the plug 20 is inserted into the socket 10 and includes: a root section 26A that is thinner than the base section 21 and is continuously formed from the base section 21 with a step; and a tip end section 26B formed on the tip end side of the root section 26A. The rail 26 is formed in a T-shape in cross section in which a width of the root section 26A is larger than that of the tip end section 26B (the width in the horizontal direction in FIG. 6). The rail 26 is formed so as to project from the base section 21 in the direction in which the plug 20 is inserted. Specifically, the rail 26 is provided with an extension 28 extending so as to project from the base section 21. Substantially in the middle of an outer surface of the tip end section 26B, a recess 27 (a lock section) is provided. The recess 27 is formed as a V-groove with a V-shape slope along a longitudinal direction (a sliding direction) of the rail 26.

The attachment 30 includes a groove 31 engaged with the rail 26 in a slidable manner and a belt attaching hole 32 (a shoulder belt attaching section) for receiving the right or left shoulder belt 7. The groove 31 is formed in a T-shape in cross section in which a width of the groove 31 on an open side (a side opposing the root section 26A) is larger than that on a depth side (a side opposing the tip end section 26B). The groove 31 extends from one end to a middle position of the attachment 30, but does not reach the other end (In other words, the groove 31 does not reach the socket 10 side surface of the attachment 30). Thus, since the rail 26 and the groove 31 have the same shape in cross section, the rail 26 and the groove 31 can be engaged with each other by sliding on each other.

Provided between the groove 31 and the belt attaching hole 32 is a connecting section 33 that connects front and rear side walls in the sliding direction of the attachment 30, the connecting section 33 being jointed only to the front and rear side walls and being elastically deformable. A protrusion 34 (a to-be-locked section) that is engaged with the recess 27 is provided in the middle of the connecting section 33, that is, in the middle of the front and rear walls in the sliding direction. The connecting section 33 is elastically deformable in a direction in which the recess 27 and the protrusion 34 are engaged (the direction in which the recess 27 is recessed and the protrusion 34 is projected). The protrusion 34 is formed so as to project in a V-shape having a V-shape slope along the longitudinal direction (the sliding direction) of the rail 26.

Hence, lateral walls of the groove 31 which have different widths on the open side and the depth side form a space substantially in a T-shape together with the connecting section 33, and the protrusion 34 (the to-be-locked section) of the connecting section 33 projects toward the open side of the groove 31.

With the arrangements described above, the attachments 30 are attached to the respective plugs 20. Specifically, the groove 31 of the attachment 30 is fitted in the rail 26 of the plug 20, and the attachment 30 is slid in the direction from the tongue piece 23 side to the base section 21 side of the plug 20. Accordingly, the connecting section 33 of the attachment 30 is elastically deformed toward the belt attaching hole 32 side, which is the upper side of the connecting section 33, as shown in FIG. 5A. As shown in FIG. 5B, when the protrusion 34 of the attachment 30 reaches the recess 27 of the rail 26, the protrusion 34 of the attachment 30 falls in (fits into) the recess 27 of the rail 26 and the connecting section 33 returns to its original shape. Thus, the attachment 30 is attached and locked to the plug 20.

In this state, the waist belt 6 attached through the belt attaching hole 25 of the plug 20 and the shoulder belt 7 attached through the belt attaching hole 32 of the attachment 30 are substantially orthogonal to each other. Hence, even when the belts 6, 7 are pulled in the orthogonal directions, the attachment 30 does not become disengaged in the direction in which the attachment is pulled owing to the tip end section 26B of the rail 26.

The plug 20 is then inserted in the socket 10 with the attachment 30 attached to the plug 20. As shown in FIG. 2, when the plug 20 is inserted in the plug 30, an inner end of the attachment 30 abuts to the stopper 13 of the socket 10, so that the attachment 30 does not become disengaged from the socket 10.

More specifically, as shown in FIG. 7, when the plug 20 is inserted in and engaged with the socket 10, the extension 28 of the rail 26 is on an upper edge of the socket 10. Accordingly, a space between the stopper 13 and the extension 28 is small, so that the attachment 30 is prevented from easily becoming disengaged. Note that since the extension 28 of the rail 26 projects from the base section 21 in the insertion direction of the plug 20, the groove 31 of the attachment 30 can be easily fit in the rail 26 when the attachment 30 is fit into the rail 26.

When the plug 20 is inserted in the socket 10, the engaging sections 24 of the tongue piece 23 of the plug 20 are engaged with the to-be-engaged sections 14 inside the socket 10, so that the plug 20 is engaged with the socket 10.

To disengage the plug 20 from the socket 10, the operation section 17 is pressed toward the rear wall 11B. This pressing makes the tongue piece 23 be deformed toward the rear wall 11B in the insertion hole 11, so that the engaging sections 24 are disengaged from the to-be-engaged sections 14, thereby releasing the engagement. The plug 20 is thus disengaged from the socket 10.

When the plugs 20 are disengaged from the socket 10, the waist belts 6 and the shoulder belts 7 are opened in horizontal directions, so that a baby can be taken out of the baby buggy. As explained above, although the attachment 30 is capable of being disengaged from the plug 20, it is not necessary to disengage the attachment 30 from the plug 20 to free the baby from the baby buggy.

Conventional attachments have a structure in which the attachment is inserted in the plug in a sliding manner. Hence, when the plug is disengaged from the socket, the attachment may also be disengaged from the plug contrary to the intention of the operator. In this case, it is necessary to attach the attachment to the plug before inserting the plug again in the socket for re-engagement, complicating the operation for engagement of the plug and the socket.

In contrast, according to the belt lock 9 of the embodiment of the invention, the attachment 30 and the plug 20 are locked by the recess 27 and the protrusion 34, so that the attachment 30 can be prevented from becoming disengaged from the plug 20 contrary to the intention of the operator, thereby providing good operability of the plug 20 and the socket 10.

Thus, the above-described embodiment can provide following advantages.

(1) When the attachment 30 is attached to the plug 20, the rail 26 and the groove 31 slide on each other to be engaged with each other and the recess 27 of the rail 26 and the protrusion 34 of the attachment 30 are engaged with each other, so that the attachment 30 can be prevented from becoming disengaged from the plug 20 contrary to the intention of the operator. Accordingly, good operability of the plug 20 and the socket 10 can be provided.

(2) The plug 20 and the attachment 30 are locked through the engagement between the recess 27 and the protrusion 34. Hence, the plug 20 and the attachment 30 can be securely locked with a simple arrangement. In addition, the V-shape slope is provided in both of the recess 27 and the protrusion 34 along the sliding direction. Hence, when the groove 31 is slid on and engaged with the rail 26, the protrusion 34 can smoothly move onto an upper surface of the rail 26 owing to a half of the V-shape slope, thereby facilitating a smooth engagement. On the other hand, when the engagement between the rail 26 and the groove 31 is released, the other half of the V-shape slope facilitates the release of the engagement.

(3) Since the connecting section 33 of the attachment 30 is elastically deformed for the engagement of the protrusion 34 into the recess 27 when attaching the attachment 30 to the plug 20, the attachment 30 can be easily attached to the plug 20 with a relatively small force. Owing to the structure in which the connecting section 33 can be elastically deformed, it is not necessary to employ a mechanism for displacing the recess 27 and the protrusion 34, thereby simplifying the structure.

(4) The rail 26 is formed in the shape in which the width of the root section 26A is larger than that of the tip end section 26B and the groove 31 is formed in the shape in which the width thereof on the open side is larger than that on the depth side, thereby providing a structure in which the rail 26 and the groove 31 do not easily become disengaged from each other except for in the sliding direction. Further, the recess 27 is formed in the outer surface of the tip end section 26B of the rail 26 and the protrusion 34 to be engaged in the recess 27 is provided on the attachment 30, thereby enabling the rail 26 and the groove 31 to engage with each other without looseness therebetween.

(5) Since the protrusion 34 is disposed in the middle of the connecting section 33 that connects the front and rear walls in the sliding direction of the attachment 30, the connecting section 33 can be easily deformed. Hence, the recess 27 and the protrusion 34 can be engaged with a relatively small force.

[Modifications]

The scope of the present invention is not restricted to the above-described embodiment, but includes modifications and improvements as long as an object of the invention can be achieved.

Figure 8:
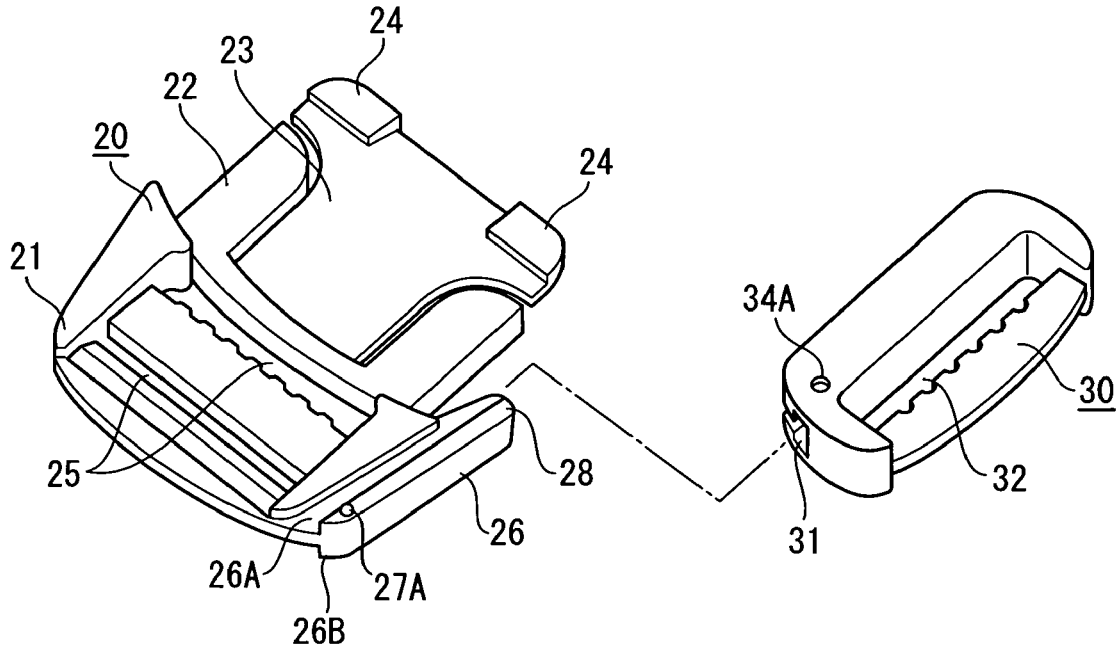
FIG. 8 is an exploded perspective view showing a modification of the invention.
Figure 9:
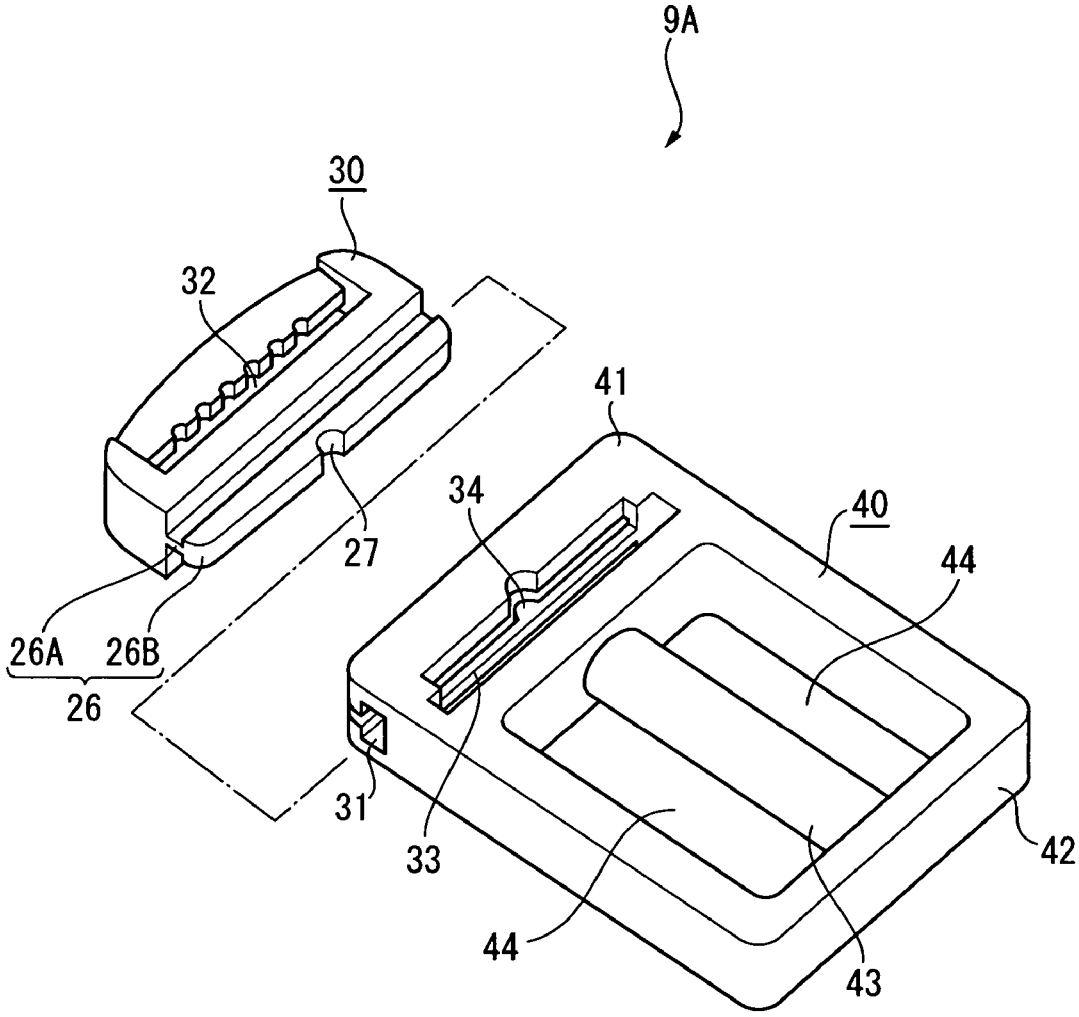
FIG. 9 is an exploded perspective view showing another modification of the invention.

For example, the lock mechanism of the plug 20 and the attachment 30 is not limited to that of the above-described embodiment, but may be the one shown in FIGS. 8 and 9.

FIG. 8 shows the plug 20 and the attachment 30 which are used for the belt lock 9 shown in FIG. 1. The lock section 27A of this exemplary modification is provided to the rail 26 of the plug 20, which is the same as the above-described embodiment. However, the lock section 27A of the modification is formed in a hemisphere shape projecting toward the front side of the plug 20. The to-be-locked section 34A is provided to the attachment 30, which is the same as the above-described embodiment. However, the to-be-locked section 34A of the modification is formed as a hole penetrating in a cylindrical shape.

Note that the lock section 27A in the hemisphere shape may be provided on both sides of the rail 26. In this case, the to-be-locked section 34A needs to be provided on both sides of the groove 31 of the attachment 30 in accordance with the lock sections 27A.

FIG. 9 shows a belt lock 9A including a base 40 and the attachment 30.

The base 40 is formed in a rectangular frame shape. A connecting bar 43 connecting lateral sides 41, 42 defines two belt insertion holes 44. On the lateral side 41 side, the groove 31 and the connecting section 33 are formed. The connecting section 33 is provided with the protrusion (the to-be-locked section) 34 and a space for allowing an elastic deformation thereof on the other side of the groove 31 of the connecting section 33.

The attachment 30 of the modification is not provided with the groove 31 and the connecting section 33 having the to-be-locked section (the protrusion) 34 which are provided to the attachment in the above-described embodiment. Alternatively, the attachment 30 of the modification is provided with the integrally-formed rail 26 having the recess (the lock section) 27.

As thus far described, although the plug 20 is provided with the rail 26 and the attachment 30 is provided with the groove 31 in the above-described embodiment, the plug 20 and the attachment 30 may be provided vice versa. Specifically, the plug 20 may be provided with the groove 31, and the attachment 30 may be provided with the rail 26.

In the above-described embodiment, the rail 26 of the plug 20 is provided with the lock section (the recess) 27 and the attachment 30 is provided with the to-be-locked section (the protrusion) 34. However, in the arrangement in which the plug 20 is provided with the groove 31 and the attachment 30 is provided with the rail 26, the rail 26 of the attachment 30 may be provided with the lock section (the recess) 27, and the plug 20 may be provided with the to-be-locked section (the protrusion) 34. In other words, it is only necessary that the lock section is provided to the rail 26 and the to-be-locked section is provided to a component provided with the groove 31.

In the above-described embodiment, the lock section is the recess 27 and the to-be-locked section is the protrusion 34. However, the lock section and the to-be-locked section may be vice versa, which means the lock section may be the protrusion 34 and the to-be-locked section may be the recess 27.

Both of the lock section and the to-be-locked section are formed in the V-groove and the V-projection which have the V-shape slope along the sliding direction. However, only one of the lock section and the to-be-locked section may be the V-groove or the V-projection. In addition, the shape of the lock section and the to-be-locked section may not be the V-groove and the V-projection but any shape as long as the lock section and the to-be-locked section can be engaged to each other.

In the above-described embodiment, the elastically deformable connecting section 33 of the attachment is provided with the to-be-locked section (the protrusion) 34, but may be provided with the lock section (the recess) 27.

In the above-described embodiment, the rail 26 and the groove 31 have the T-shape in cross section. However, the shapes thereof are not limited thereto, but may be any as long as the rail 26 and the groove 31 do not easily become disengaged from each other. For example, arranging the rail and the groove in a converted trapezoidal shape can provide advantages similar to the above-described embodiment.

The priority application Number JP2005-224514 upon which this patent application is based is hereby incorporated by reference.

What is claimed is:

1. A belt lock, comprising:

a base; and an attachment to be detachably attached to the base, the attachment having a belt attaching section for attaching a belt, wherein:

the base includes a socket and a plug that is disengageable from the socket, the plug includes a base section and an engaging section that projects from the base section and is inserted in and engaged with the socket, the base section includes a rail formed substantially in parallel to a direction in which the plug is inserted into the socket, the attachment includes: a groove to be slidably engaged with the rail, the rail is provided with a lock section and the groove is provided with a to-be-locked section to be engaged with the lock section, the rail includes:

a root section continuously formed from the base; and a tip end section formed on a tip end side of the root section, the tip end section having a width larger than that of the root section, a width of the groove on a depth side is larger than that on an open side, the lock section is formed as a recess on an outer surface on a tip end side of the rail, and the to-be-locked section is formed as a protrusion to be engaged with the recess.

2. The belt lock according to claim 1, wherein at least one of the recess and the protrusion has a V-shape slope along the sliding direction of the rail and the groove.

3. The belt lock according to claim 1, wherein the to-be-locked section is provided on a connecting section connecting front and rear walls in a direction in which the attachment is slid, the to-be-locked section being disposed at a middle position between the front and rear walls in the sliding direction of the attachment, the connecting section is deformable in a direction in which the lock section and the to-be-locked section are engaged.

* * * * *